United States Patent [19]

Townsend

[11] Patent Number: 4,457,499

[45] **Date of Patent: * Jul. 3, 1984**

[54] PILE DRIVER CUSHION

[75] Inventor: Peter Townsend, Forked River, N.J.

[73] Assignee: Metex Corporation, South Plainfield, N.J.

[ * ] Notice: The portion of the term of this patent subsequent to Jul. 20, 1999 has been disclaimed.

[21] Appl. No.: 333,640

[22] Filed: Dec. 23, 1981

Related U.S. Application Data

[63] Continuation-in-part of Ser. No. 115,342, Jan. 25, 1980, Pat. No. 4,340,210.

[51] Int. Cl.[3] ..... F16F 7/00

[52] U.S. Cl. ..... 267/137

[58] Field of Search ..... 188/371, 376, 377, 381; 267/136, 137

[56] References Cited

U.S. PATENT DOCUMENTS 4,340,210 7/1982 Townsend ..... 267/137

*Primary Examiner*—Duane A. Reger

[57] ABSTRACT

In a pile driver the sharp force loading on a pile at the moment of impact by a ram is absorbed by a pile driver cushion. The cushion includes a pad formed from a flexible strip of compressed knitted mesh wound in a flat spiral and further constructed to maintain its integrity during use and handling.

2 Claims, 6 Drawing Figures

FIG. 3
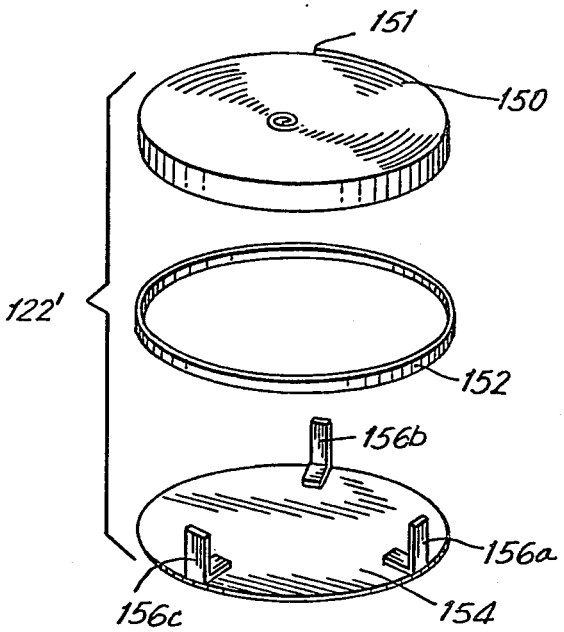
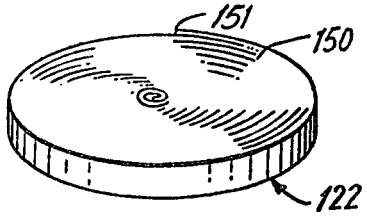
FIG. 2
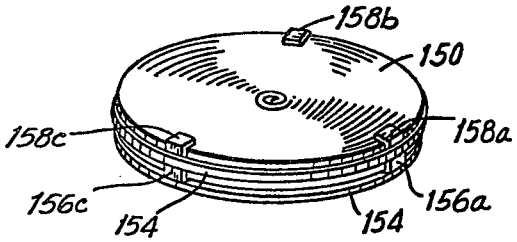
FIG. 4
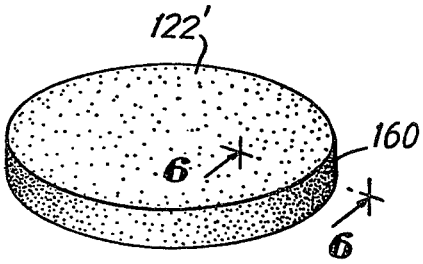
FIG. 5
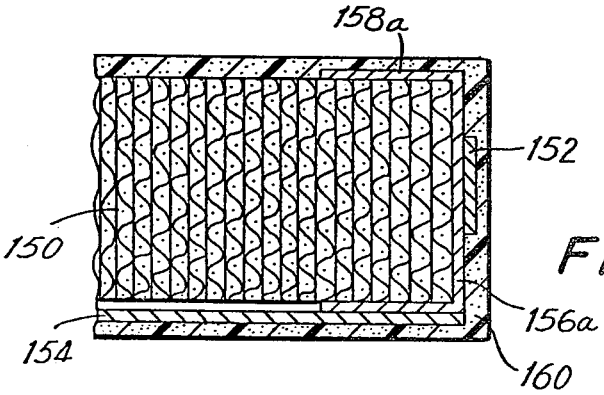
FIG. 6

PILE DRIVER CUSHION

BACKGROUND OF THE INVENTION

This is a continuation-in-part of U.S. patent application Ser. No. 115,342, filed Jan. 25, 1980, now U.S. Pat. No. 4,340,210.

This invention relates in general to a pile driver cushion, and more particularly, to a pile driver cushion fabricated from a flexible strip of compressed knitted wire mesh or knitted polymer and wire mesh. The term "knitted mesh" shall refer generally to both knitted wire mesh and polymeric-metallic construction.

Piles are long slender member usually made from trimmed timber, steel or reinforced concrete which are driven downward and into the ground or seabed by means of an apparatus called a pile driver or pile hammer, to support vertical loads such as large buildings, bridges or oil drilling platforms.

The pile driver utilizes a falling weight or ram which is operated by steam, compressed air or by diesel. The ram is not allowed to directly strike the top of the pile as this would cause mushrooming in the case of steel piles or chipping or spalling in the case of concrete piles. To prevent this problem, a steel case with a horizontal partition, known as a helmet, is placed on top of the pile. The underside of the helmet is shaped to conform to the dimensions or configuration of the top of the pile. The top of the helmet has a circular cavity in which is placed a cushion of resilient material. This material acts as a shock absorber and blunts the sharp force loading on the pile at the moment of impact. It also prevents damage to the pile driver when the pile reaches refusal which is generally defined as the point where pile driving resistance exceeds either 300 blows of the hammer per foot for five consecutive feet or 800 blows for one foot when the pile weight does not exceed four times the weight of the hammer.

Cushion materials in current usage fall into three groups; (1) end grain hickory, oak or similar hardwoods, (2) circular pads ¼ inch to ½ inch thick fabricated from asbestos with certain fillers, and (3) round plates of aluminum alternating with disks made from medium weave cotton impregnated with a phenolic resin compound and cured into rigid sheets.

When energy is put at a high rate into cushions made from the above materials, their temperature climbs rapidly causing a reduction in the efficiency of driving and contributing to the eventual deterioration of the cushion. Hardwood cushions frequently ignite spontaneously when temperatures above their ignition point are reached. Asbestos based cushions do not catch fire. However, they compact down into a solid rock like mass that has no resiliency or cushioning effect and have to be replaced at frequent intervals. The phenolic resin disks deteriorate through their inability to dissipate heat and while the alternating aluminum disks help dissipate heat somewhat, they do not contribute to the resiliency of the assembly.

There is thus a clear and heretofore unsolved problem of improving the shock absorbing materials used in a pile driving operation.

Metal shock absorbing elements of stainless steel wire have been used for vibration damping in applications where vibration and shock are at relatively low levels. For example, in drilling for oil, the weight of the drilling apparatus is transmitted to the drilling bit producing predominantly vibration loading and to a lesser extent, impact loading on the drilling bit during the drilling operation. The tubular drilling string normally includes an anti-vibration and shock tool (known as a "Shock or Damping Sub") positioned immediately above the drill bit for smoothing out the small scale vibration and impact loads associated with the drilling operation. The shock sub includes a stainless steel wire knitted into a cloth like mesh and compressed in a compression die into an annular ring. The annular ring is positioned around the shaft of the shock sub in such a manner as to receive the axial load on the drill bit.

The annular ring is fabricated in an annular ring-shaped die of fixed volume by isostatic compression. In one technique, a tubular stocking of knitted wire mesh is rolled upon itself from each end to form a double doughnut of approximately 4½–5½" in outside diameter. The double doughnut is placed within the annular cavity of the compression die and is subsequently compressed with appropriate force to compact the double doughnut into a uniform annular ring structure. This ring structure is found to be of uniform resiliency since the problem of material flow which is known to occur in larger volume die cavities is not significant in a compression die of relatively small volume.

The sharp impact loads which occur during a pile driving operation are at least ten times greater than the vibrational and impact loads encountered in a well drilling operation where the predominant force is one of vibration.

Thus a wire mesh annular ring constructed for absorbing forces occurring in a drilling operation will not absorb the forces which occur during a pile driving operation at a steady rate of about 50–60 blows per minute. To be effective to protect the pile driver and the pile during the steady force loading which occurs during the pile driver operation, a cushion of knitted wire mesh must have uniform resiliency and must retain that resiliency during the entire pile driving operation, conditions which knitted wire mesh heretofore have not been able to obtain.

Cushions for use in a pile driver operation are fabricated in sizes ranging from 6" to 72" in diameter. The fabrication of cushions from knitted wire mesh over this range of diameters cannot be successfully or economically fabricated in one piece in a compression die. It is contemplated, that if a tubular stocking of knitted wire mesh were placed within a large volume die cavity and compressed using isostatic compression to form a cushion in a manner similar to that used to form the annular ring used in the vibration tool, the problem of material flow within the die cavity would result in the cushion being of non-uniform resiliency. Further, to fabricate cushions having different diameters would require a compression die for each cushion of desired diameter which is generally impractical from an economic consideration.

It is also expected that cushions fabricated in a compression die would not be capable of achieving a density sufficiently high to impart the resiliency required for use in a pile driving operation. This is due to the extremely high force required to form a compressed knitted wire pad to the approximate 50% density range required for the cushion. For example, a small 12" diameter cushion would require approximately 2800 tons axially applied. Larger cushions, which are quite common, will require increased forming loads directly related to the cushion area. It is not economically practical to use hydraulic presses and tooling of the magnitude for making die formed cushions.

The use of a pile driver cushion of non-uniform resiliency and low density in a pile driving operation would result in the cushion being rapidly further compressed under the action of the pile driver to a point where the resiliency of the cushion would be insufficient to protect either the pile driver or the pile from damage.

SUMMARY OF THE INVENTION

It is broadly an object of this invention to provide a pile driver cushion which overcomes or avoids one or more of the foregoing disadvantages resulting from use of conventional pad materials. Specifically, it is within the contemplation of the present invention to provide a pile driver cushion with the resilient pad section fabricated from knitted mesh.

A further object of the present invention is to provide a pile driver cushion of knitted wire mesh having uniform resiliency and sufficient density for use in a pile driver.

Another object of the present invention is to provide a pile driver cushion of knitted polymeric and wire. In a specific aspect of the invention, the polymeric is polypropylene.

A further object of the present invention is to provide a pile driver cushion of knitted mesh which can be readily fabraciated into cushions of varying diameters without the need for dies of different diameter.

A further object of the present invention is to provide a pile driver cushion of knitted mesh having unique heat dissipating qualities that enable it to operate at considerably lower temperatures than other pad materials currently available, i.e., 200°-250° F. versus 600°-700° F.

A still further object of this invention is to provide a pile driver cushion that maintains its resiliency or cushioning effect to give considerably longer service life compared with other materials under the same operating conditions.

A still further object of this invention is to provide a pile driver cushion having an improved ability to transfer energy in a controlled manner from the ram to the top of the pile so that piles can be driven faster and with less blows under similar operating conditions compared with other cushions fabricated from other materials.

A still further object of this invention is to provide a pile driver cushion fabricated from knitted mesh which retains its density during a pile driving operation.

In accordance with the present invention, there is provided a pile driver cushion for absoring the sharp force loading on the pile at the moment of impact by a ram during the operation of a pile driver. In one embodiment of the invention, the pile driver cushion is fabricated of a layer of knitted wire mesh formed into a spiral and constructed to retain its structural integrity during the pile driving operation. In another embodiment of the invention, the pile driver cushion is fabricated of a layer of knitted polymeric and metallic wires.

In one particular construction of the invention, the pile driver cushion is fabricated from knitted mesh which is compressed into a flexible strip of uniform resiliency and wound in a spiral to form a circular pad. A circular plate having a plurality of tabs extending from its surface supports one surface of the pad. A band is wrapped around the periphery of the pad to prevent the unwinding of the pad. The pad is secured to the support plate by the plurality of tabs which are bent over the top edge of the pad. For pads constructed of knitted wire mesh, the circular band and circular plate are encapsulated with epoxy to maintain the integrity of the assembly during use and handling. Epoxy encapsulation or other forms of coating compatible with the particular polymeric could be used.

BRIEF DESCRIPTION OF THE DRAWINGS

The above brief description as well as further objects and features and advantages of the present system will be more fully understood by reference to the following detailed description of a presently preferred nonetheless illustrative pile driver cushion in accordance with the present invention when taken in conjunction with the accompanying drawings, wherein:

FIG. 2 is a perspective view of one embodiment of a pile driver cushion fabricated from knitted mesh according to the present invention;

FIG. 3 is an exploded perspective view of the components of the pile driver cushion prior to assembly;

FIG. 4 is a perspective view of the pile driver cushion as shown in FIG. 3 after assembly;

FIG. 5 is a perspective view of a fabricated pile driver cushion formed from knitted wire mesh after encapsulation in epoxy; and FIG. 6 is a side sectional view taken along lines 5—5 in FIG. 5 showing the construction of one embodiment of the fully assembled pile driver cushion according to the present invention.

DETAILED DESCRIPTION OF THE PREFERRED EMBODIMENT

Figure 1:
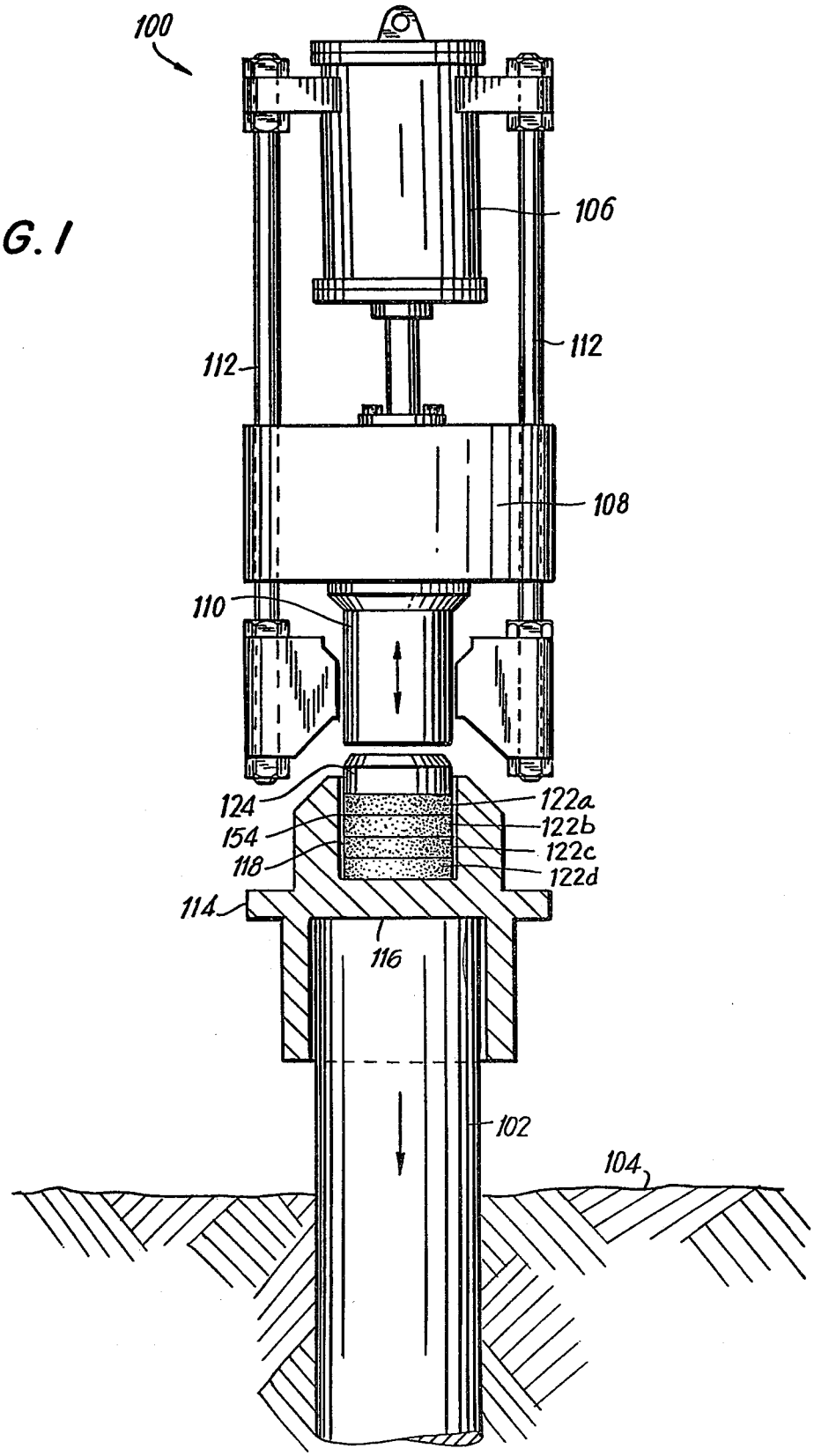
FIG. 1 is a partially sectioned, side elevation of a pile driver apparatus including a pile driver helmet in place on top of a pile with a plurality of pile driver cushions constructed according to the present invention, positioned in the helmet to absorb the shock of the pile driver ram.

Referring to FIG. 1, a pile driver apparatus 100 is shown generally incorporating a plurality of pile driver cushions **122*a*–122*d* according to this invention. A pile 102 of timber, steel or reinforced concrete is located on ground 104, onshore or offshore, to be driven into the ground. Pile driver apparatus 100 utilizes a steam, compressed air or diesel operated cylinder 106 to operate falling weight 108 which has attached at one end thereof a pile driver ram 110. The rising and falling of weight 108 is guided by vertical guideposts 112**.

In operation, cylinder 106 operates to raise weight 108 and ram 110 upward in a vertical direction to a point where cylinder 106 releases weight 108, which under the force of steam or compressed air pressure or through diesel operation is driven down to impart a striking force to the top of pile 102 by ram 110.

To prevent destruction of end 116 of pile 102 by the action of ram 110, a helmet 114 is provided to absorb the force of the ram's impact. Helmet 114 is shaped on its underside to conform to the dimensions or configurations of end 116 of pile 102. Helmet 114 is further provided at its top side with a circular recess 118 in which is placed a plurality of pile driver cushions **122*a*–122*d* and a striker plate 124**.

The pile driver cushions, **122*a*–122*d*, act as shock absorbers to blunt the sharp loading force on pile 102 at the moment of impact by ram 110 and also to prevent damage to pile driver 100 when pile 102 reaches refusal. As ram 110 strikes striker plate 104, these forces are transmitted to the top of pile 102** to drive the pile into the ground.

In the broadest aspect of this invention, a pile driver cushion 122 is fabricated from knitted mesh formed into a circular pad 150 (FIG. 2). In one embodiment of the present invention, the knitted mesh is knitted wire mesh formed in a knitting process which produces a low density mesh of interlocking metallic loops that can move relative to each other in the same plane without distorting the mesh, thereby giving the mesh a two-way stretch. The knitting machine consists of a series of knitting needles placed around a cylinder to knit a continuous stocking of mesh. The spacing of the needles primarily determines the opening size, i.e., density of the knitted mesh (density number, e.g., "60 density,"). The knitting machine output is a continuous stocking of mesh, which is pulled through the knitter by take-up rollers.

To form circular pad 150, the knitted wire mesh is made into a flexible strip of generally rectangular cross-section by running the mesh through calendering rollers. During the calendering operation, the low density knitted mesh is compressed into a resilient flexible strip having a preferred density in the range of from 48–52% (percent volume of metal). By compressing the knitted mesh between two confining calendering rollers, the compressed knitted wire mesh achieves a uniform resiliency at a high density, e.g., 48–52%.

The flexible strip is wound into a tight flat spiral upon itself to the diameter of the pile driver cushion 122. The loose end 151 of the wound flexible strip is secured to the outside turn of the pad 150 to prevent the pad 150 from unwinding. The can be accomplished by welding loose end 151 to the outside turn or by placing a band 152 around the periphery of the turns (FIG. 4). The completed pile driver cushion has a final preferred density in the range of from 45–48%. It is possible to fabricate the pile driver cushion at a lower density, e.g., 42–43%, and allow the action of the pile driver ram to further slightly compress the pile driver cushion to a density within the preferred range of from 45–48%.

In application, a plurality of cushions 122 are inserted into the helmet 114 of the pile driver, and in maintaining all of the turns of cushion 122 in the same plane during the pile driving operation, a support plate 154 may be disposed between each pile driver cushion (FIG. 1).

Referring to FIG. 3, the components of a pile driver cushion 122' are illustrated according to another embodiment. A pile driver cushion 122' which absorbs the shock produced by the striking forces of the ram, is fabricated from a circular pad 150 of knitted wire mesh compressed into a flexible strip of generally rectangular cross section of from 48–52% density and wound in a flat spiral upon itself, a flat metal circular band 152 having a diameter approximately the same as the diameter of pad 150, and a flat metal circular support plate 154 of substantially the same size as the pad 150, having a plurality of tabs or clips **156*a*–156*c*, somewhat longer than the thickness of pad 150, secured around the periphery of the support plate 154** and arranged to extend perpendicular to the plate's surface.

Referring to FIGS. 4–6, the assembly of the elements of the pile driver cushion 122' as illustrated in FIG. 3 is described. A flat metal circular band 152 is wrapped around the periphery of pad 150 to prevent the pad from unwinding. Circular pad 150 is then centrally positioned on top of support plate 154 between the plurality of clips **156*a*–156*c*. The clips are positioned to extend upward beyond the top surface of the circular pad 150. The clips 156*a*–156*c* may be positioned either between the circular band 152 and the pad 150 or positioned on the outside of the circular band 152. Ends 158*a*–158*c* are bent over in a direction substantially perpendicular to the clips such that the bent over portion of the clips securely retain the circular pad 150 to the support plate 154. The pad 150 may be secured to the support plate 154 by a construction other than the use of the clips 158*a*–158*c*. For example, a band may be placed radially around the pad 150 and support plate 154 to integrate the support plate with the pad. As will be described, the pad 150, the band 152 and the support plate 154 may be encapsulated with material to maintain the integrity of the cushion 122'**.

The epoxy material 160 enhances the appearance of the pile driver cushion 122, aids in preventing the center of the pad 150 from popping out during handling and in operation, protects against corrosion during storage and further insures the integrity of the cushion 122', as illustrated in FIG. 5. Other materials of the thermoplastic or thermosetting type may be used to encapsulate the assembly, according to the present invention, such as acrylics, polyesters, polyvinylchlorides, silicone, etc.

It should be readily apparent to one having ordinary skill in the art that this invention contemplates the use of a pile driver cushion of a pad of a compressed flexible strip of knitted mesh having uniform resiliency wound into a flat spiral and further constructed to maintain its integrity during operation. The integrity of the pile driver cushion 122 may be maintained during use and handling by incorporating such features as welding the loose end 151 of the flexible strip or incorporating a circular band 152 around the pad 150, providing an integrated support plate 154, including on the support plate clips 156 to secure the pad to the plate, and encapsulating the cushion, for example, in epoxy material. It is to be understood that other structures and features for maintaining the integrity of the cushion may be employed without departing from the invention.

As thus described, the pile driver cushion 122 of this invention provides a number of advantages over the prior art pile driver cushions, and in particular, to the annular ring structure used in absorbing shock in a well drilling operation. In particular, the pile driver cushion provides a cushion of uniform resiliency and having a density which provides maximum service life and efficiency to the pile driver cushion. Accordingly, piles may be driven faster and with less blows at considerably lower cushion temperatures while enjoying longer service life when incorporating a pile driver cushion of the present invention.

By way of an illustrative example, plain steel wire, 0.011 inch diameter, is knitted in a strip to a width of from $5\frac{1}{2}$–$6\frac{3}{4}$ inches, at 6 courses per inch, and having a weight of from 3.25–3.75 oz./ft. The knitted mesh is calendered into a strip of generally rectangular cross section of about $1\frac{1}{8}\times 0.200$ inches, and having a weight of from 5.25–5.50 oz./ft., which corresponds to a density of about 48–52%. A typical size of pad has the calendered strip wound as tight as possible to approximately an $11\frac{1}{4}$ inch diameter flat circular pad weighing from $14\frac{1}{2}$ to 15 lbs., which corresponds to a density of about 45–48%. Obviously, larger diameter pads which are 45 to 48% dense are also heavier. The pad is prevented from unwinding by welding the free end of the strip to the last turn of the pad thereby completing the assembly of a pile driver cushion 122 according to this invention. As previously described, a plurality of pile driver cushions are placed within the helmet separated by a support plate 154.

In another illustrative example, the pad 150 fabricated according to the previous example, was placed within a circular metal band 152 to prevent the pad from unwinding, thereby eliminating the welding operation. The pad 150 was placed on a steel support plate 154 11⅜ inches in diameter by 18 gauge having 3 extending retaining clips 156*a*–156*c*. The incorporation of an integrated support plate 154 eliminated the need for a separate support plate as described in the previous example. The end portions 158*a*–158*c* were bent over the top surface of the pad to secure the pad to the disk. The completed assembly was encapsulated using an epoxy resin 160. The finished cushion 122' including pad 150, disk 154, banding 156 and epoxy 160 weighed approximately 16¼ lbs.

The mesh may be knit from metal wires ranging in diameter from 0.0035 inches to 0.011 inches and from wires of other selected metals. i.e., galvanized steel, stainless steel, aluminum, hastelloy, etc. The pile driver cushion 122 may be fabricated in any diameter from 6 inches to 72 inches having a density of 45–48% without losing its stated operating characteristics.

In another embodiment of the invention, the knitted wire mesh contains one strand of flat polypropylene monofilament parallelled with two strands of 0.011" diameter plain carbon steel wire. The polypropylene monofilament has a nominal cross-section size of approximately 0.008"×0.030", subject to at least ±10% variation because of the technical limitations of the extrusion process from which it is made. Proportions of the polypropylene and steel are approximately 15% to 20% polypropylene and 80% to 85% steel on a weight basis. If an attempt should be made to substantially increase the polypropylene content, for example, by doubling the polypropylene content or by halving the steel wire content, it would not be possible to fabricate a sufficiently compacted calendered strip from the knitted wire mesh due to overwhelming reflexive forces that would be induced by the polypropylene. When there is sufficient steel wire, the deformation of the steel during calendering produces a constraint that stabilizes the strip cross-section.

The polypropylene-metallic mesh is calendered as described above and then wound into pad having a net density of approximately 0.09 lb./cu. in. Variation of this density by plus or minus 20% would still provide viable pile driver cushioning. The pad is then formed into a cushion as described above with reference to FIGS. 3 and 4. Epoxy encapsulation or other encapsulation materials compatible with polypropylene or other polymeric in the mesh could be used.

A polymeric/metal cushion, such as the polypropylene/ metal cushion described above has certain properties which differ from an all-wire construction making the polypropylene construction better suited for certain applications. For example, it has a lower spring constant then the all-metal cushion. Cushion resiliency is related to the overall pile driving efficiency, and in those cases where the need for the softer polypropylene/metal cushion has been indicated it was found that less hammer blows per inch of pile penetration were required.

Softness of the polypropylene/metal cushion is partially due to the natural softness and elasticity of the polypropylene monofilament. Another contributing factor to softness is the slight mobility with the cushion structure as provided by the lubricating effect of polypropylene when it is compressed in the interstices of the wire matrix. The polypropylene also prevents progressive permanent deformation of the steel wires as may occur in an all-metal mesh structure when it is subjected to repetitive compressive forces.

One application for polypropylene/metal cushions is in preventing damage to concrete piles when the cushion is positioned directly on top of the pile to serve as a stress relieving member between the hammer and the pile.

While epoxy encapsulation is not used on polypropylene/ metal cushions, because of the possible damaging effects of the curing heat on the polypropylene, other forms of coating could be used. In any event, the coating would merely provide protection in handling, corrosion protection during storage, and improved appearance. It would not have any useful influence on the mechanical performance of the cushion.

Although the invention herein has been described with reference to particular embodiments, it is to be understood that these embodiments are merely illustrative of the principles and application of the invention. For example, other polymerics can be used. Thus, it is to be understood that numerous modifications may be made in the illustrative embodiments and other arrangements may be devised without departing from the sphere and scope of the invention as defined by the appending claims.

What I claim is:

1. A pile driver cushion for effecting the controlled transfer energy from a pile driver ram to a pile during the operation of a pile driver comprising a pad formed from knitted mesh including knitted polymer and wire mesh compressed into a flexible strip of substantially uniform density wound upon itself into a spiral having a preselected diameter and secured to retain its structural integrity while effecting the controlled transfer of energy from a pile driver ram to a pile during a pile driver operation.

2. A pile driver cushion for effecting controlled transfer of energy from a pile driver ram to a pile during the operation of a pile driver comprising a pad formed from knitted mesh including knitted polymer and wire mesh compressed by calendering into a flexible strip of substantially uniform density wound upon itself into a spiral having a preselected diameter and first and second relatively flat opposed surfaces, said mesh spiral having substantially uniform density, a flat circular mounting plate having a diameter substantially equal to the diameter of the knitted mesh spiral and having plural retaining tabs attached to said circular plate at selected locations, said tabs extending substantially at right angles to the surface of said circular plate, a circular retaining band having a preselected diameter, said knitted mesh spiral positioned with its first surface in contact with one surface of said mounting plate with said retaining tabs extending over the second surface of said knitted mesh spiral, said tabs being bent inwardly to overlay at least a portion of the second surface of said knitted mesh spiral, said circular retaining band encircling said knitted mesh with said tabs being positioned between said band and said knitted mesh spiral and material encapsulating said knitted mesh, mounting plate and retaining band whereby said pile driver cushion effects the controlled transfer of energy from the pile driver ram to a pile during the operation of the pile driver.

* * * * *